United States Patent [19]

Thomi et al.

[11] 4,363,553

[45] Dec. 14, 1982

[54] WATCH MECHANISM INCORPORATING TWO BARRELS

[75] Inventors: Michel Thomi, Saint-Imier; Raymond Studer, La Chaux-de-Fonds, both of Switzerland

[73] Assignee: Compagnie des Montres Longines Francillon S.A., Saint-Imier, Switzerland

[21] Appl. No.: 88,064

[22] Filed: Oct. 24, 1979

Related U.S. Application Data

[63] Continuation of Ser. No. 963,107, Nov. 22, 1978, abandoned, which is a continuation of Ser. No. 878,590, Feb. 16, 1978, abandoned, which is a continuation of Ser. No. 606,937, Aug. 22, 1975, abandoned.

[51] Int. Cl.³ ..... G04B 1/10

[52] U.S. Cl. ..... 368/140; 368/139; 368/148; 368/142

[58] Field of Search ..... 58/86, 87, 46 R, 48, 58/59, 73, 136; 185/38, 40 A, 40 K, 39; 368/148, 140, 142

[56] References Cited

U.S. PATENT DOCUMENTS 3,479,813 11/1969 Kocher ..... 368/208

FOREIGN PATENT DOCUMENTS 22272 11/1958 France .
71490 1/1960 France .
72074 10/1915 Switzerland .
135521 4/1929 Switzerland .
152299 1/1932 Switzerland .
151391 3/1932 Switzerland .
161349 4/1933 Switzerland .
538715 6/1973 Switzerland .

OTHER PUBLICATIONS

P. Bequin, "Higher Frequency of the Balance Means Improved Precision, How? Why? In What Areas?", pp. 324–329, Swiss Watch and Jewelry Journal, May 1972.
Defossez, Cours d'Horlogerie (4th Ed., 1950).
Drehganguhren Deutsche Uhrmacher-Zietung—1925, pp. 857–859; 901–903; 969–971.
Drehganguhren Deutsche Uhrmacher-Zeitung—1926, pp. 825–828.
Maire, "Les barillets à rotation rapide", Bulletin annuel de la Société de Chronometrie V (1967), pp. 86–87.

*Primary Examiner*—Bernard Roskoski
*Attorney, Agent, or Firm*—Imirie & Smiley

[57] ABSTRACT

A watch mechanism incorporating two barrels each containing a spring. The springs contained in each barrel are positively connected in series to each other via a gear mechanism or a common arbor.

The considerable energy available makes it possible to maintain the movement of a high frequency spring balance oscillator. The barrel rotates rapidly to drive the first pinion of the train of gears with an angular velocity approximately double relative to the normal angular velocities; the torque is approximately half (600 gr.mm) that of conventional-sized watch mechanism of comparable performance.

The barrels may be mounted coaxially or in the same plane and the mechanism can be arranged to be wound manually or automatically.

22 Claims, 6 Drawing Figures

60
61
62
63
64
65
66
67
35
25
23
16
12
14
19
18
22
15
13
2
3
7
8
9
10
1

WATCH MECHANISM INCORPORATING TWO BARRELS

This is a continuation of application Ser. No. 963,107 filed Nov. 22, 1978, now abandoned; which is a continuation of application Ser. No. 878,590 filed Feb. 16, 1978, now abandoned; which in turn is a continuation of application Ser. No. 606,937 filed Aug. 22, 1975, now abandoned.

BACKGROUND OF THE INVENTION

The present invention concerns a water comprising two driving barrels each containing a spring and ensuring an independent period of operation of less than 72 hours.

The precision of a watch strictly depends on the regulating power of the spring balance wheel oscillator, a conception which expresses the invariability of the period of a balance wheel under the effect of influences such as temperature, variation in the torque on the escapement wheel, accelerations and shock. The regulating capacity is proportional to the moment of inertia, the square of the amplitude, and the cube of the frequency of the balance wheel. This latter factor plays the most important part and, in particular, a "high regulating power" is referred to when the balance wheel oscillates with a frequency greater than 3.4 Hz. In order to maintain the movement of an oscillator of this type, high driving energy is necessary, too high to be provided by a spring of the conventional barrel, the volume of which is limited by the size of the movement.

Hence the idea of replacing one driving barrel by two barrels, providing the same energy, but more easily disposed rationally in a cage.

Let us consider a barrel spring capable of storing potential energy E during re-winding and of returning it in kinetic form, driving the gear train mechanism and the oscillator; the driving barrel then turns with an angular velocity w, providing a torque M (mean value), during a time T corresponding to the independent operation of the watch, namely $$E = M \cdot W \cdot T \qquad \text{(a)}$$

If two barrels are coupled in any manner, and the springs of these are assumed to be identical, to simplify the reasoning, it is obvious that the energy 2E is then available. The equation (a) may be checked in a variety of ways, for example:

$$2E = M \cdot (2T) \cdot w \qquad \text{(b)}$$
$$= (2M) \cdot T \cdot w \qquad \text{(c)}$$
$$= M \cdot T \cdot (2w) \qquad \text{(d)}$$

With solution (b), the available energy is exploited to obtain autonomous operation for time 2T as, for example, in the case of a known watch working over a long period (216 hours of independent operation), in which the barrels are coaxial and the springs disposed in series. The total torque working on the first pinion of the mechanism is equal to the torque of one of the springs.

With solution (c) the springs work in parallel and exert a torque 2M (the torques are added together) on the first member of a gear train. A watch is known in which this solution is applied, comprising two barrels, disposed on the same plane, which simultaneously engage the center-wheel. The considerable energy available makes it possible to maintain the movement of a high frequency spring balance oscillator (more than 30,000 alternations per hour), thus improving the performance of the watch without diminishing the working reserve of the watch (50 h). However, the high torque (of the order of 1500–2000 gr.mm) created by the combined action of the two driving springs implies considerable forces which result in deterioration of the conditions of engagement and pivoting of the components of the mechanism that a total yield of the gear-train mechanism is reduced, since part of the available energy is dissipated in overcoming friction.

In order to improve to some extent the yield of the mechanism of this watch, the ratio of the gearing between each of the barrels and the centre pinion has been modified (1:5 instead of 1:7). The barrels then turn faster (30% faster than previously); the torque is reduced at the same ratio and, all things otherwise remaining equal, the yield is slightly improved.

This prior art may still be considerably improved, and this is the object of the invention.

SUMMARY OF THE INVENTION

According to the present invention there is provided a watch mechanism comprising two driving barrels, each containing a spring and ensuring an independent operation of less than 72 hours, wherein the said springs are connected in series, one of the ends of the first spring being positively connected to one of the ends of the second spring, the other end of one of the springs being secured to a toothed wheel which maintains by means of a gear train, the movement of a spring balance oscillator having a high regulating power.

In the case in which the transmission of the positive link is equal to 1, which is the case of equation (d), the barrels rotate rapidly to drive the first pinion of the train of gears with an angular velocity approximately double relative to the normal angular velocities. The torque is approximately half that of a conventional sized movement of comparable performance. The advantages are as follows:

Weak specific pressures of the pivots and teeth of the mechanism which are meshing, hence reduction of the friction forces, wear, fatigue and simplification of the problems of lubrication.

The multiplication ratio of the gear-train mechanism is divided by two, however, the yield of the gears increases when the transformation ratio decreases and when the transmitted torque is weak. It is possible to select more pinions having smaller modules, hence providing a reduction in the diameter of the gears. It is also possible to omit one of the moving bodies of the gearing.

Maintenance of the spring balance oscillator is effected under very good conditions, since the variation of the elastic movement is weaker when the springs are placed in series. Moreover, the increase in the speed of rotation of the barrel causes a reduction in the operating period of the teeth of the barrel and centre gearing, the influence of which becomes negligible on the amplitude of the oscillations of the balance wheel (in general 5 to 10%).

A special arrangement also makes it possible to improve the total yield of the "gear-train winding mechanism" assembly in producing a watch as described above, in which the positive link between the springs is effected by gears, the transmission ratio of which differs from 1: in the case of a manually wound watch (ratio >1), or further increases the angular driving velocity of the gear-train, and, consequently, the output of the watch; in the case of an automatically wound watch (ratio <1), the output of the winding mechanism is improved.

Finally, the embodiments of the present invention are compatible with the optimal conditions of a barrel spring: it has been demonstrated (cf. Bulletin annuel de la Société Suisse de Chronometrie, 1967, Vol V, Page 552 and the following, a communication from M. Aurele Maire, "Rapidly rotating barrels"). The barrel spring occupies the smallest volume for a given energy E when the number of development turns of the spring is nearest to 9 (difference of the number of turns of the spring between the "wound" and the "unwound" position).

DETAILED DESCRIPTION OF THE INVENTION

Figures 1, 2:
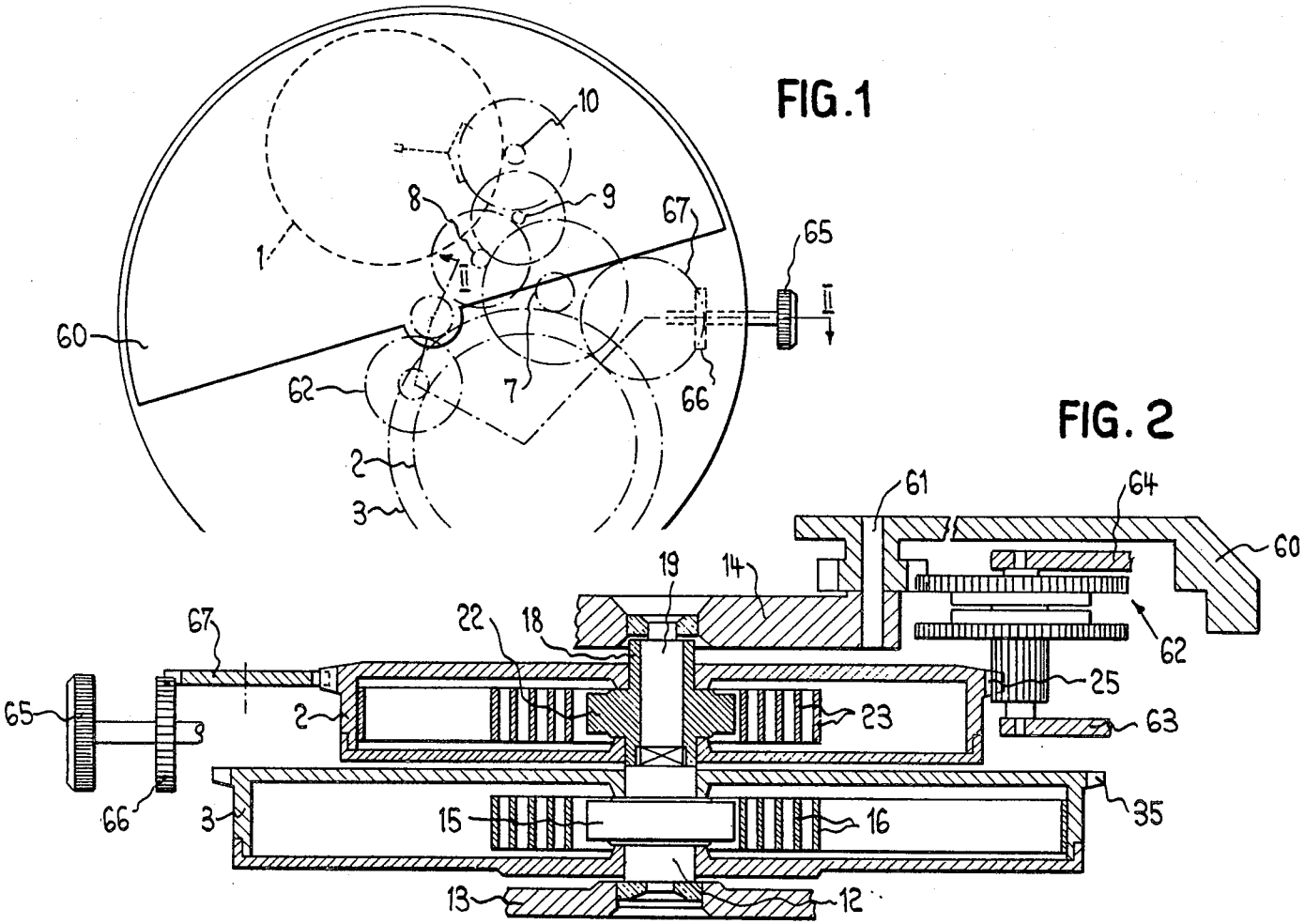
FIG. 1 is a plan view of a first embodiment of the invention.
FIG. 2 is a sectional view on a larger scale taken on the line II—II of FIG. 1.

The automatic winding watch movement shown in FIGS. 1 and 2 comprises a first barrel 3 rotating on a arbor 12, a driving spring 16 being hooked onto the barrel 3 at its outer end, and to the core 15 of the barrel arbor 12 at its inner end. A second barrel 2, coaxial with the first, turns on an arbor 18 connected to the extension 19 of the arbor 12 by means of a known coupling device (Swiss Pat. No. 324,249). The driving spring 23 is also hooked onto the barrel 2 and to the core 22 of the arbor 18. The arbor 12 pivots between a plate 13 and a bridge 14.

The teeth 25 of the barrel 2 co-operate with a displaceable reverser 62, pivoted between the bridges 63 and 64 which makes it possible to recover the energy of the oscillating mass 60, whatever its direction of rotation may be around the spindle 61. The teeth 25 also engage with the crown wheel 67 of the usual mechanism for re-setting and manually winding the watch including the winding pinion 66 and the crown 65. In some embodiments winding may be manual. In the course of winding, the winding torque exerted on the spring 23 drives the arbor 18, the arbor 12, and arms the spring 16. The springs 16 and 23 are disposed in series, i.e., they are wound in opposite direction so that the torque resulting from the action of the two springs is equal, at any instant, to the torque exerted by one of the two springs, the numbers of development turns being added together. For example:

$$M=K\alpha=K_1\cdot\alpha_1=K_2\cdot\alpha_2 \qquad \text{(e)}$$

where

M=torque exerted by each of the springs

K=elastic constant of the spring $\alpha$=angle of rotation of the spring corresponding to the total number of development turns and equal to the sum of the two separate spring angles, i.e. $\alpha_1+\alpha_2$ and 1, 2 are suffixes relating to each of the springs. Hence:

$$\frac{M}{K}=\alpha=\alpha_1+\alpha_2=M\left(\frac{1}{K_1}+\frac{1}{K_2}\right) \qquad \text{(f)}$$

The equivalent elastic constant of two springs disposed in series is smaller than that of each of the springs taken separately, because:

$$1/K=(1/K_1)+(1/K_2) \text{ which implies: } K<K_1 \text{ or } K_2 \qquad \text{(g)}$$

With two springs in series the slope of the function M=F (number of development turns) is relatively slight. This is one of the reasons why the maintenance of the spring balance oscillator is effected under good conditions.

If $K_1=K_2$, then:

$$K=K_1/2;\ \alpha=2\alpha_1$$

The elastic constant $K_1$ is divided by two so that $$M=(K_1/2)\cdot 2\alpha_1=K_1\cdot\alpha_1,$$

characteristic of a single spring.

In the embodiment shown in FIGS. 1 and 2 (or 3 and 4) the springs are not necessarily identical. For different sections of the bent blade forming the spring, it is possible to combine the following conditions: samd torque, number of development turns nearest to 9 (optimal dimensioning), and equal stress.

When the driving barrels supply energy, the barrel 2 (in fact, a hollowed-out sprocket wheel) is stationary and the barrel 3 turns with an angular velocity equal to the sum of the angular velocities of the unwinding of the springs 23 and 16, the outer turn of the latter being hooked in the barrel 3.

The teeth 35 of the barrel 3 engage the first pinion 7 of the going gear train, formed by the pinions and wheels 8, 9 and 10 driving a high regulating power spring balance oscillator 1.

The high angular velocity of the barrel 3 makes it possible to select a going train which has a multiplication ratio approximately half that of a conventional going train.

Figure 3:
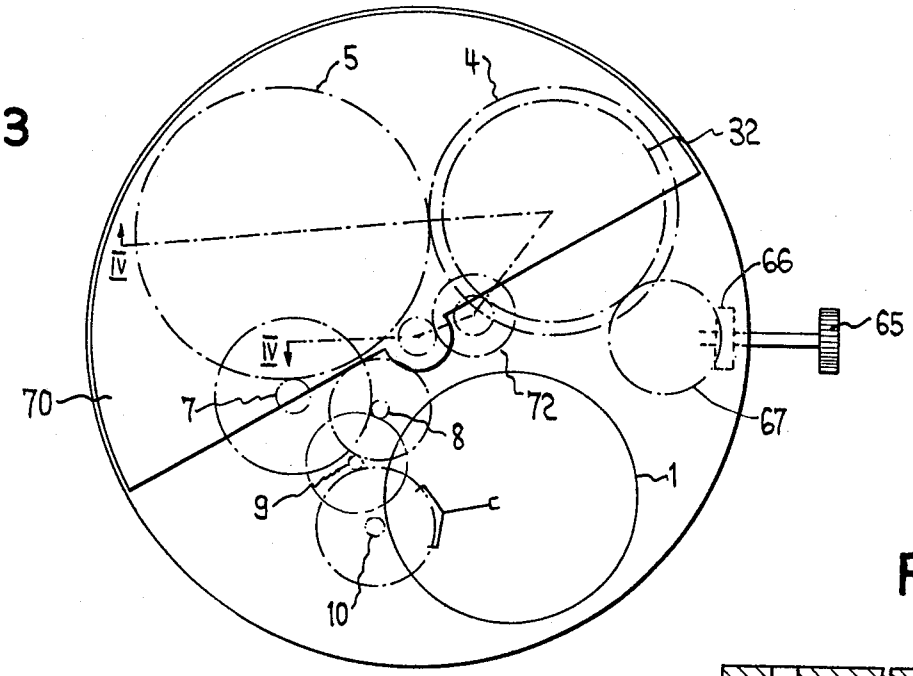
FIG. 3 is a plan view of a second embodiment of the invention.
Figure 4:
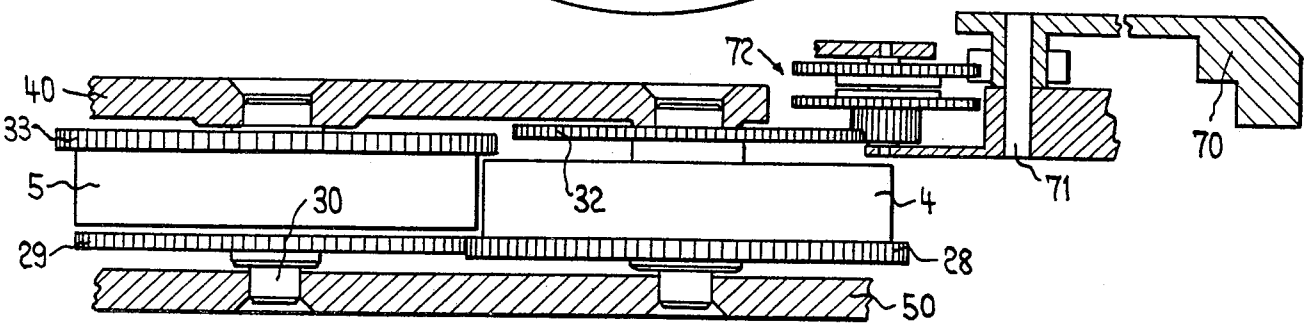
FIG. 4 is a partial section, on a larger scale taken on the line IV—IV of FIG. 3.

FIGS. 3 and 4 show a variant of the present invention in which the barrels 4 and 5 are disposed in the same plane, between the plate 40 and the bridge 50. The teeth 28 of the barrel 4 co-operate with a wheel 29 mounted on the arbor 30 of the barrel 5 in order to ensure the positive drive link between the outer turn of the spring located in the barrel 4 and the inner turn of the spring of the barrel 5. The springs are wound so that they work in series. A ratchet-wheel 32 permits automatic winding of the springs, due to the usual means, composed, among others, of the oscillating mass 70 which turns around the spindle 71 of the displaceable reversing member 72. In other embodiments, it is possible to provide a manual winding mechanism, a feature which makes the oscillating mass and the components which are associated therewith unnecessary.

The teeth 33 of the barrel 5 engage the first pinion 7 of the going gear train. The kinematics are the same as those described with reference to FIG. 1, the same components being indicated in the same manner. The transmission ratio of the gears 28 and 29 is equal to 1.

Figure 5:
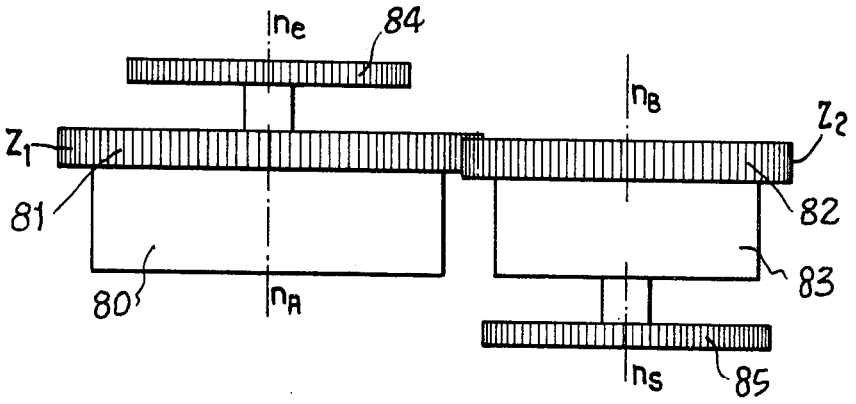
FIG. 5 is a schematic view in elevation of a third embodiment of the invention.

FIG. 5 shows schematically another embodiment of the present invention in which the barrels are disposed in the same plane. The barrel 80 is provided with teeth 81 co-operating with teeth 82 on the barrel 83, however, the ratio of the number of teeth $Z_1/Z_2$ differs from 1. Automatic or manual winding is achieved by means of a ratchet wheel 84, and the wheel 85 drives the first pinion of the going gear train. The inner turns of the springs (not shown) located in the barrels 80 and 83 are connected to arbors associated with the wheels 84 and 85. The springs work in series.

For the total number of development turns of the two springs in series, a simple calculation gives:

$$n_{output}=n_B+n_A\cdot(Z_1/Z_2)$$

In a manually wound watch, a driving member (barrel) is desired capable of yielding the largest possible number of output turns $n_s$. Moreover, it is desirable to limit the number of turns of the winding crown during the daily winding of the watch.

With $Z_1/Z_2>1$ the angular speed of the wheel 85 is greater than the sum, in absolute values, of the angular speeds of the barrels 80 and 83, that is to say $n_s>n_A+n_B$. The angular speeds of the barrels correspond to the speed of unwinding of the springs.

In this case, the angular speed of the wheel 85 is further increased relatively to the embodiments which have already been described. Consequently, the performance of the going gear train is improved.

On the other hand, the number of winding turns (manual winding) is reasonable, because:

$$n_{input}=n_A+n_B\cdot(Z_2/Z_1)<(n_B+n_A),$$

because $$Z_2/Z_1<1$$

hence manual winding is faster.

In the case of an automatic watch, $Z_1/Z_2<1$ can be selected. The train of gears of the automatic winding system is then simplified, for the winding reduction-gear ratios are smaller, in fact:

$$n_e=n_A+n_B\cdot Z_2/Z_1>(n_B+n_A), \text{ because}$$

$$Z_2/Z_1>1.$$

The springs associated with the barrels 80 and 83 do not supply an identical torque. The greater of the torques is created by the spring contained in the larger of the barrels, a feature which simplifies optimal dimensioning of the springs of both barrels.

Figure 6:
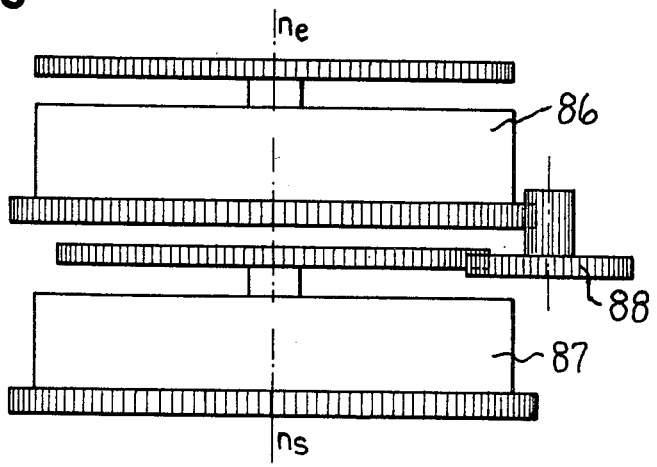
FIG. 6 is a schematic elevational view of a fourth embodiment of the invention.

The same considerations apply (See FIG. 6) to coaxial barrels 86, 87. The springs (not shown) located in the barrels work in series and are connected by means of a pinion and gear 88 which engages on the one hand, with teeth on the barrel 86 and, on the other hand, with a wheel secured to the inner turn of the spring in the barrel 87. The outer turn of this spring is hooked on the barrel 87 which is provided with teeth meshing with the first pinion of the going gear train.

For independent operation of less than 72 hours, the energy stored in the assembly of both barrels ensures the maintenance of a spring balance wheel assembly having an oscillating frequency greater than 3.4 Hz, the output speed of the assembly being from 0.3 to 0.4 turns per hour (the usual speed is approximately 0.1 to 0.2 turns per hour). This rapid rotation makes it possible therefore to reduce the multiplication ratio of the pinions and wheels 7, 8, 9 and 10, a feature which improves the kinimatics of the gearing system. It is also possible to omit one of the members of the going gear train.

The low torque (of the order of 600 gr.mm) is the essential advantage which derives from the use of rapidly rotating barrels: the low specific pressures reduce stresses on the pivots and the teeth of the gear mechanism and the problems of lubrication are practically eliminated. This provides a guarantee of reliability.

The two springs have a number of development turns in the region of 9 (optimal condition), and since the springs are in series, the total number of development turns is therefore approximately equal to 18.

The choice of "coaxial barrels" or "barrels on the same plane" depends on aesthetic considerations or, for an automatically wound watch, on the configuration of the oscillating mass.

I claim:

1. A watch mechanism having a running time of less than 72 hours comprising a first and second driving barrel, a first and second spring respectively contained in said first and second driving barrel, said springs being connected in series, one of the ends of said first spring being positively connected to one of the ends of said second spring, the other end of one of the springs being secured to a toothed wheel which maintains, by means of a gear-train, the movement of a spring balance oscillator, the transmission ratio of the gear-train and the springs being chosen so that the angular velocity of the barrel containing the second spring is higher than 0.3 turns per hour.

2. A watch mechanism according to claim 1, in which said positive connection between the springs is achieved by a gear mechanism.

3. A watch mechanism according to claim 2, in which the transmission ratio of the said gear mechanism is greater than 1, so that the angular speed of the said toothed wheel is greater than the sum, in absolute values, of the angular unwinding speeds of the said first and second springs.

4. A watch mechanism according to claim 2, in which the transmission ratio of the said gear mechanism is smaller than 1, so that the angular speed of the said toothed wheel is smaller than the sum, in absolute values, of the angular unwinding speeds of the said first and second springs.

5. A watch mechanism according to claim 2, in which the transmission ratio of the said toothed wheel is equal to the sum, in absolute values, of the angular unwinding speeds of the said first and second springs.

6. A watch mechanism according to claim 1, in which the said spring balance oscillator has a frequency greater than 3.4 Hz.

7. A watch mechanism according to claim 4, in which the number of development turns of each of the said spring is approximately 9.

8. A watch mechanism according to claim 1, in which the said first and second barrels are disposed coaxially.

9. A watch mechanism according to claim 1, in which the said barrels are disposed in the same plane.

10. A watch mechanism according to claim 3 or 5 in which the watch mechanism is manually wound.

11. A watch mechanism according to claim 4 or 5 in which the watch mechanism is automatically wound.

12. A watch mechanism according to claim 8, in which the first spring is secured at its outer end to the first barrel, and a ratchet wheel is provided associated with said first barrel, whilst the first and the second spring are connected at their inner ends to arbors of said first and second barrels, which arbors are connected to each other, the second spring being connected to the second barrel at its outer end, which second barrel is provided with teeth engaging a first member of the gear train.

13. A watch mechanism according to claim 3 or 4, in which the first and second barrels are disposed coaxially and the said springs are connected by means of a gear member which engages, on the one hand, with teeth of the first barrel, containing the first spring and, on the other hand, with a wheel connected to the inner end of the second spring, the outer end of which second spring is engaged on the second barrel which is provided with teeth engaging a first gear member of the gear train.

14. A watch mechanism according to claim 3 or 4 in which the barrels are disposed in the same plane and the toothed wheel is connected to the inner turn of the said second spring.

15. A watch mechanism according to claim 5, in which the barrels are disposed in the same plane and the toothed wheel is connected to the inner turn of the said second spring.

16. A watch mechanism according to claim 3 or 4, in which the barrels are disposed in the same plane and the toothed wheel is connected to the barrel containing the second spring.

17. A watch mechanism according to claim 5, in which the barrels are disposed in the same plane and the toothed wheel is connected to the barrel containing the second spring.

18. A watch mechanism having a running time of less than 72 hours comprising a first driving barrel;

a second driving barrel;

a first spring contained in said first driving barrel;

a second spring contained in said second driving barrel;

means for connecting said first and second springs in series such that one of the ends of said first spring is positively connected to one of the ends of said second spring;

a spring balance oscillator;

a gear train connected between said spring balance oscillator and one of said barrels such that said one barrel can maintain the movement of said spring balance oscillator, said gear train comprised of a plurality of interconnected wheels and pinions that are free from any connection to a minute wheel and having a transmission ratio which in combination with said springs is chosen so that the sum of the angular velocities of said driving barrels is at least 0.3 turns per hour.

19. A watch mechanism as claimed in claim 18 and further comprising an escapement mechanism; and wherein said spring balance oscillator has a high regulating power and is coupled to said escapement mechanism;

and said gear train mechanically couples said second driving barrel to said escapement mechanism so as to provide a running time less than 72 hours and such that the sum of the angular velocity of said first and second driving barrels is higher and the resulting torque of said first and second springs is lower than the values of the angular velocity and torque of a watch barrel having an angular velocity of from 0.1 to 0.2 turns per hour.

20. A watch mechanism as claimed in claim 19 wherein said gear train has a multiplication ratio less than 1.7, whereby the specific pressures on the pivots and teeth of said gear train mechanism is less than for such watch movement resulting in reduced frictional forces, wear, and fatigue of said gear train mechanism.

21. A watch mechanism according to claim 20 wherein said first and second springs are connected in series, one of the ends of said first spring being positively connected to one of the ends of said second spring, the other end of one of the springs being connected to said gear train, and wherein the transmission ratio of said gear train and said springs being chosen so that the angular velocity of said second driving barrel is at least 0.3 turns per hour.

22. A watch mechanism as claimed in claim 19 wherein said gear train provides a angular velocity sum of said first and second driving barrels that is at least twice the angular velocity in such watch movement that has a driving barrel with an angular velocity of from 0.1 to 0.2 turns per hour and said gear train has a torque that is no more than one-half the torque of the gear train in said such watch movement.

* * * * *

UNITED STATES PATENT AND TRADEMARK OFFICE

CERTIFICATE OF CORRECTION

PATENT NO. : 4,363,553

DATED : December 14, 1982

INVENTOR(S) : Michel Thomi & Raymond Studer

It is certified that error appears in the above—identified patent and that said Letters Patent is hereby corrected as shown below:

On the cover page, add the following information:

--[30] FOREIGN APPLICATION PRIORITY DATA

Priority claimed on Swiss Patent Application No. 11,478/74, filed August 22, 1974--.

Signed and Sealed this

Twenty-ninth Day of March 1983

[SEAL]

Attest:

GERALD J. MOSSINGHOFF

Attesting Officer

Commissioner of Patents and Trademarks